US006029125A

United States Patent [19]

Hagen et al.

[11] Patent Number: 6,029,125

[45] Date of Patent: Feb. 22, 2000

[54] REDUCING SPARSENESS IN CODED SPEECH SIGNALS

[75] Inventors: Roar Hagen, Stockholm; Björn Stig Erik Johansson, Spånga; Erik Ekudden, Åkersberga; Willem Baastian Kleijn, Tullinge, all of Sweden

[73] Assignee: Telefonaktiebolaget L M Ericsson, (publ), Stockholm, Sweden

[21] Appl. No.: 09/110,989

[22] Filed: Jul. 7, 1998

Related U.S. Application Data

[63] Continuation-in-part of application No. 09/034,590, Mar. 4, 1998

[60] Provisional application No. 60/057,752, Sep. 2, 1997.

[51] Int. Cl.[7] ..... G10L 9/00

[52] U.S. Cl. ..... 704/201; 704/267; 704/268

[58] Field of Search ..... 704/268, 267, 704/201

[56] References Cited

U.S. PATENT DOCUMENTS 5,806,037 9/1998 Sogo ..... 704/268

FOREIGN PATENT DOCUMENTS 0709827 5/1996 European Pat. Off. ..... G10L 9/14
9113432 9/1991 WIPO ..... G10L 9/14
9618185 6/1996 WIPO ..... G10L 3/02

OTHER PUBLICATIONS

Proceedings of 1998 IEEE International Conference on Acoustics, Speech and Signal Processing, ICASSP 1998; "Removal of Sparse–Excitation Artifacts in CELP"; vol. 1, May 12–15, 1998; Seattle, WA; pp. 145–148; XP002083369.

Patent Abstracts of Japan, JP 05 158497 A (Fujitsu); Jun. 25, 1993; abstract.

*Primary Examiner*—David R. Hudspeth
*Assistant Examiner*—Susan Wieland
*Attorney, Agent, or Firm*—Jenkens & Gilchrist, P.C.

[57] ABSTRACT

Sparseness is reduced in an input digital signal which includes a first sequence of sample values. An output digital signal is produced in response to the input digital signal. The output digital signal includes a second sequence of sample values, which second sequence of sample values has a greater density of non-zero sample values than the first sequence of sample values.

32 Claims, 7 Drawing Sheets

0
2000
4000Hz
1
0.5
2
-2
-4
-0.5
-1
5
10
15
20
25
30
35
40
7

4000Hz
3000
0
0.5
1
2
-2
-1
5
7
10
15
20
25
30
35
40

REDUCING SPARSENESS IN CODED SPEECH SIGNALS

REDUCING SPARSENESS IN CODED SPEECH SIGNALS

This application claims the priority under 35 USC 119 (e) (1) of copending U.S. Provisional Application Ser. No. 06/057,752, filed on Sep. 2, 1997, and is a continuation-in-part of copending U.S. Ser. No. 09/034,590, filed on Mar. 4, 1998.

FIELD OF THE INVENTION

The invention relates generally to speech coding and, more particularly, to the problem of sparseness in coded speech signals.

BACKGROUND OF THE INVENTION

Speech coding is an important part of modern digital communications systems, for example, wireless radio communications systems such as digital cellular telecommunications systems. To achieve the high capacity required by such systems both today and in the future, it is imperative to provide efficient compression of speech signals while also providing high quality speech signals. In this connection, when the bit rate of a speech coder is decreased, for example to provide additional communication channel capacity for other communications signals, it is desirable to obtain a graceful degradation of speech quality without introducing annoying artifacts.

Conventional examples of lower rate speech coders for cellular telecommunications are illustrated in IS-641 (D-AMPS EFR) and by the G.729 ITU standard. The coders specified in the foregoing standards are similar in structure, both including an algebraic codebook that typically provides a relatively sparse output. Sparseness refers in general to the situation wherein only a few of the samples of a given codebook entry have a non-zero sample value. This sparseness condition is particularly prevalent when the bit rate of the algebraic codebook is reduced in an attempt to provide speech compression. With very few non-zero samples in the codebook to begin with, and with the lower bit rate requiring that even fewer codebook samples be used, the resulting sparseness is an easily perceived degradation in the coded speech signals of the aforementioned conventional speech coders.

It is therefore desirable to avoid the aforementioned degradation in coded speech signals when the bit rate of a speech coder is reduced to provide speech compression.

In an attempt to avoid the aforementioned degradation in coded speech signals, the present invention provides an anti-sparseness operator for reducing the sparseness in a coded speech signal, or any digital signal, wherein sparseness is disadvantageous.

DETAILED DESCRIPTION

Figure 1:
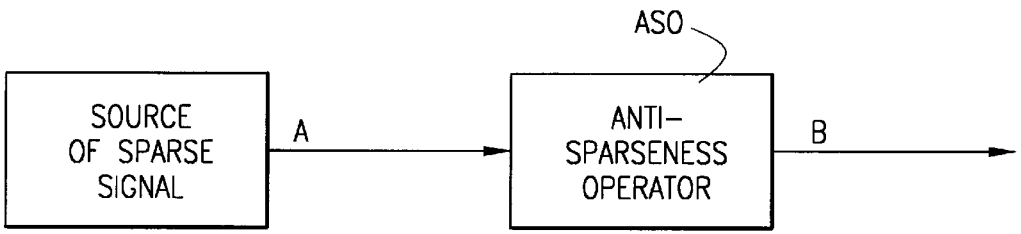
FIG. 1 is a block diagram which illustrates one example of an anti-sparseness operator of the present invention.

FIG. 1 illustrates an example of an anti-sparseness operator according to the present invention. The anti-sparseness operator ASO of FIG. 1 receives at input A thereof a sparse, digital signal received from a source 11. The anti-sparseness operator ASO operates on the sparse signal A and provides at an output thereof a digital signal B which is less sparse than the input signal A.

Figure 2:
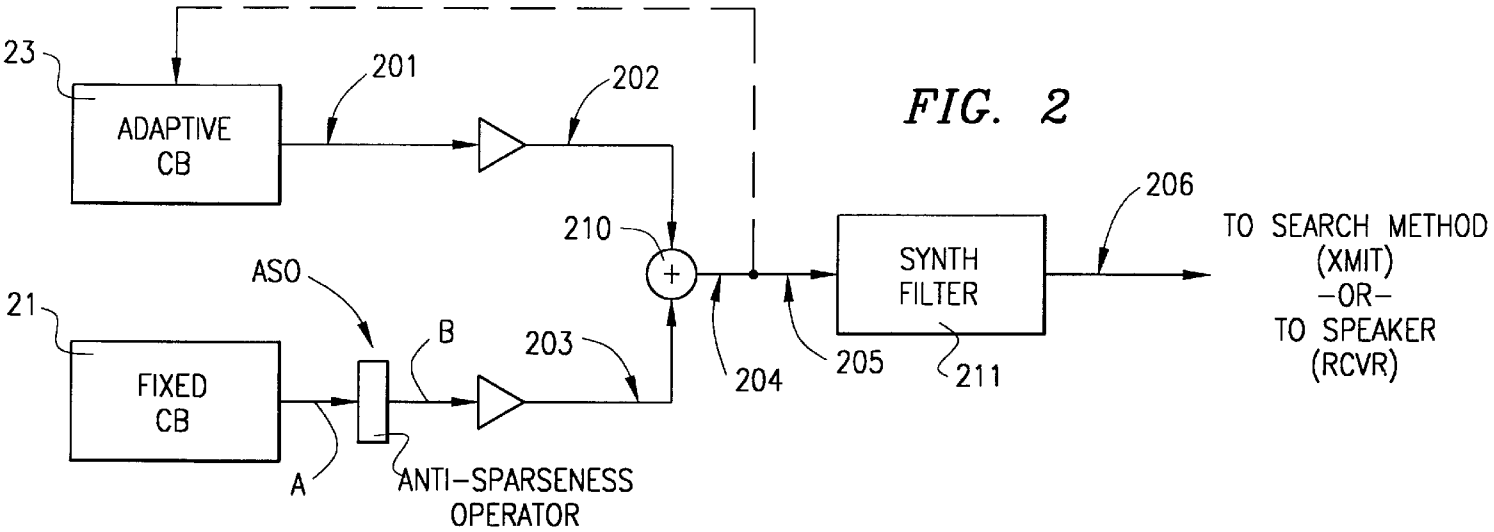
FIG. 2 illustrates various positions in a Code Excited Linear Predictive encoder/decoder where the anti-sparseness operator of FIG. 1 can be applied.

FIG. 2 illustrates various example locations where the anti-sparseness operator ASO of FIG. 1 can be applied in a Code Excited Linear Predictive (CELP) speech encoder provided in a transmitter for use in a wireless communication system, or in a CELP speech decoder provided in a receiver of a wireless communication system. As shown in FIG. 2, the anti-sparseness operator ASO can be provided at the output of the fixed (e.g, algebraic) codebook 21, and/or at any of the locations designated by reference numerals 201–206. At each of the locations designated in FIG. 2, the anti-sparseness operator ASO of FIG. 1 would receive at its input A the sparse signal and provide at its output B a less sparse signal. Thus, the CELP speech encoder/decoder structure shown in FIG. 2 includes several examples of the sparse signal source of FIG. 1.

The broken line in FIG. 2 illustrates the conventional feedback path to the adaptive codebook as conventionally provided in CELP speech encoders/decoders. If the anti-sparseness operator ASO is provided where shown in FIG. 2 and/or at any of locations 201–204, then the anti-sparseness operator(s) will affect the coded excitation signal reconstructed by the decoder at the output of summing circuit 210. If applied at locations 205 and/or 206, the anti-sparseness operator(s) will have no effect on the coded excitation signal output from summing circuit 210.

Figure 2A:
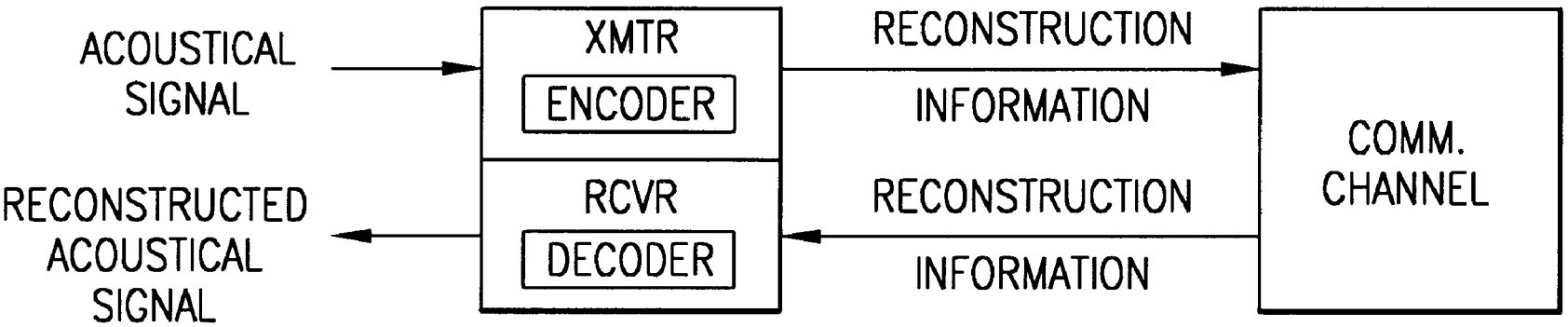
FIG. 2A illustrates a communications transceiver that can use the encoder/decoder structure of FIGS. 2 and 2B.
Figure 2B:
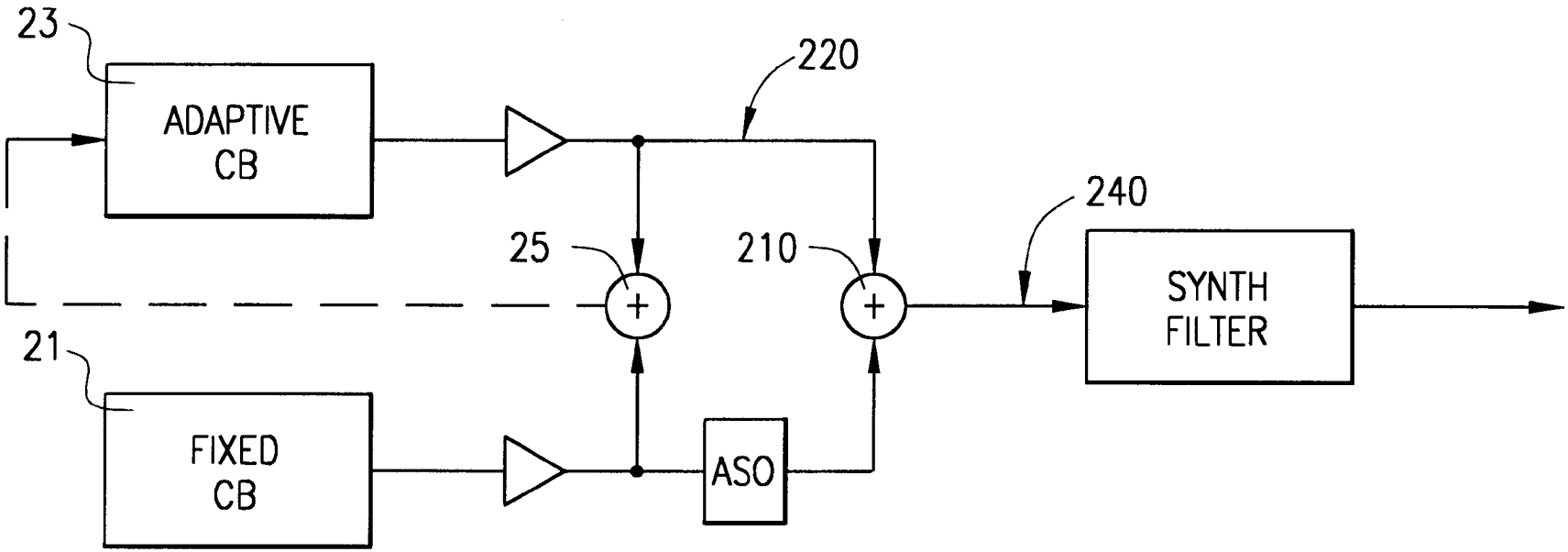
FIG. 2B illustrates another exemplary Code Excited Linear Predictive decoder including the anti-sparseness operator of FIG. 1.

FIG. 2B illustrates an example CELP decoder including a further summing circuit 25 which receives the outputs of codebooks 21 and 23, and provides the feedback signal to the adaptive codebook 23. If the anti-sparseness operator ASO is provided where shown in FIG. 2B, and/or at locations 220 and 240, then such anti-sparseness operator(s) will not affect the feedback signal to the adaptive codebook 23.

FIG. 2A illustrates a transceiver whose receiver (RCVR) includes the CELP decoder structure of FIG. 2 (or FIG. 2B) and whose transmitter (XMTR) includes the CELP encoder structure of FIG. 2. FIG. 2A illustrates that the transmitter receives as input an acoustical signal and provides as output to the communications channel reconstruction information from which a receiver can reconstruct the acoustical signal. The receiver receives as input from the communications channel reconstruction information, and provides a reconstructed acoustical signal as an output. The illustrated transceiver and communications channel could be, for example, a transceiver in a cellular telephone and the air interface of a cellular telephone network, respectively.

Figure 4:
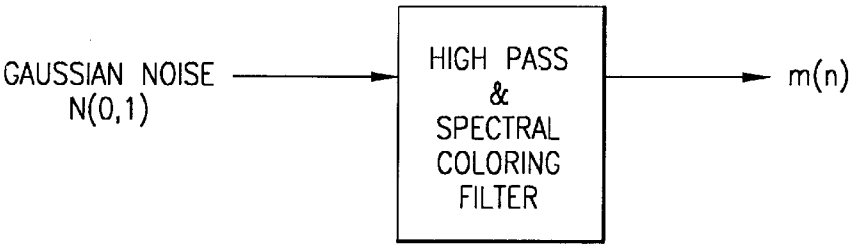
FIG. 4 illustrates one example of how the additive signal of FIG. 3 can be produced.
Figure 3:
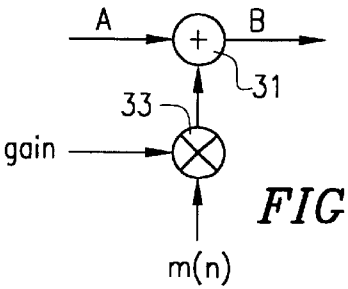
FIG. 3 illustrates one example of the anti-sparseness operator of FIG. 1.

FIG. 3 illustrates one example implementation of the anti-sparseness operator ASO of FIG. 1. In FIG. 3, a noise-like signal m(n) is added to the sparse signal as received at A. FIG. 4 illustrates one example of how the signal m(n) can be produced. A noise signal with a Gaussian distribution N(0,1) is filtered by a suitable high pass and spectral coloring filter to produce the noise-like signal m(n).

As illustrated in FIG. 3, the signal m(n) can be applied to the summing circuit 31 with a suitable gain factor via multiplier 33. The gain factor of FIG. 3 can be a fixed gain factor. The gain factor of FIG. 3 can also be a function of the gain conventionally applied to the output of adaptive codebook 23 (or a similar parameter describing the amount of periodicity). In one example, the FIG. 3 gain would be 0 if the adaptive codebook gain exceeds a predetermined threshold, and linearly increasing as the adaptive codebook gain decreases from the threshold. The FIG. 3 gain can also be analogously implemented as a function of the gain conventionally applied to the output of the fixed codebook 21 of FIG. 2. The FIG. 3 gain can also be based on power-spectrum matching of the signal m(n) to the target signal used in the conventional search method, in which case the gain needs to be encoded and transmitted to the receiver.

In another example, the addition of a noise-like signal can be performed in the frequency domain in order to obtain the benefit of advanced frequency domain analysis.

Figure 5:
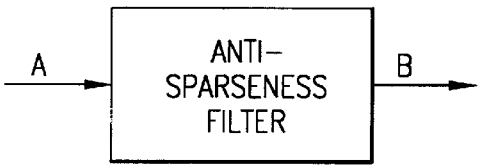
FIG. 5 illustrates in block diagram form how the anti-sparseness operator of FIG. 1 can be embodied as an anti-sparseness filter.

FIG. 5 illustrates another example implementation of the ASO of FIG. 2. The arrangement of FIG. 5 can be characterized as an anti-sparseness filter designed to reduce sparseness in the digital signal received from the source 11 of FIG. 1.

Figure 6:
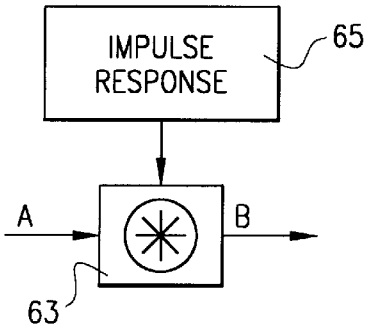
FIG. 6 illustrates one example of the anti-sparseness filter of FIG. 5.

One example of the anti sparseness filter of FIG. 5 is illustrated in more detail in FIG. 6. The anti-sparseness filter of FIG. 6 includes a convolver section 63 that performs a convolution of the coded signal received from the fixed (e.g. algebraic) codebook 21 with an impulse response (at 65) associated with an all-pass filter. The operation of one example of the FIG. 6 anti-sparseness filter is illustrated in FIGS. 7–11.

Figures 7, 8, 9, 10, 11:
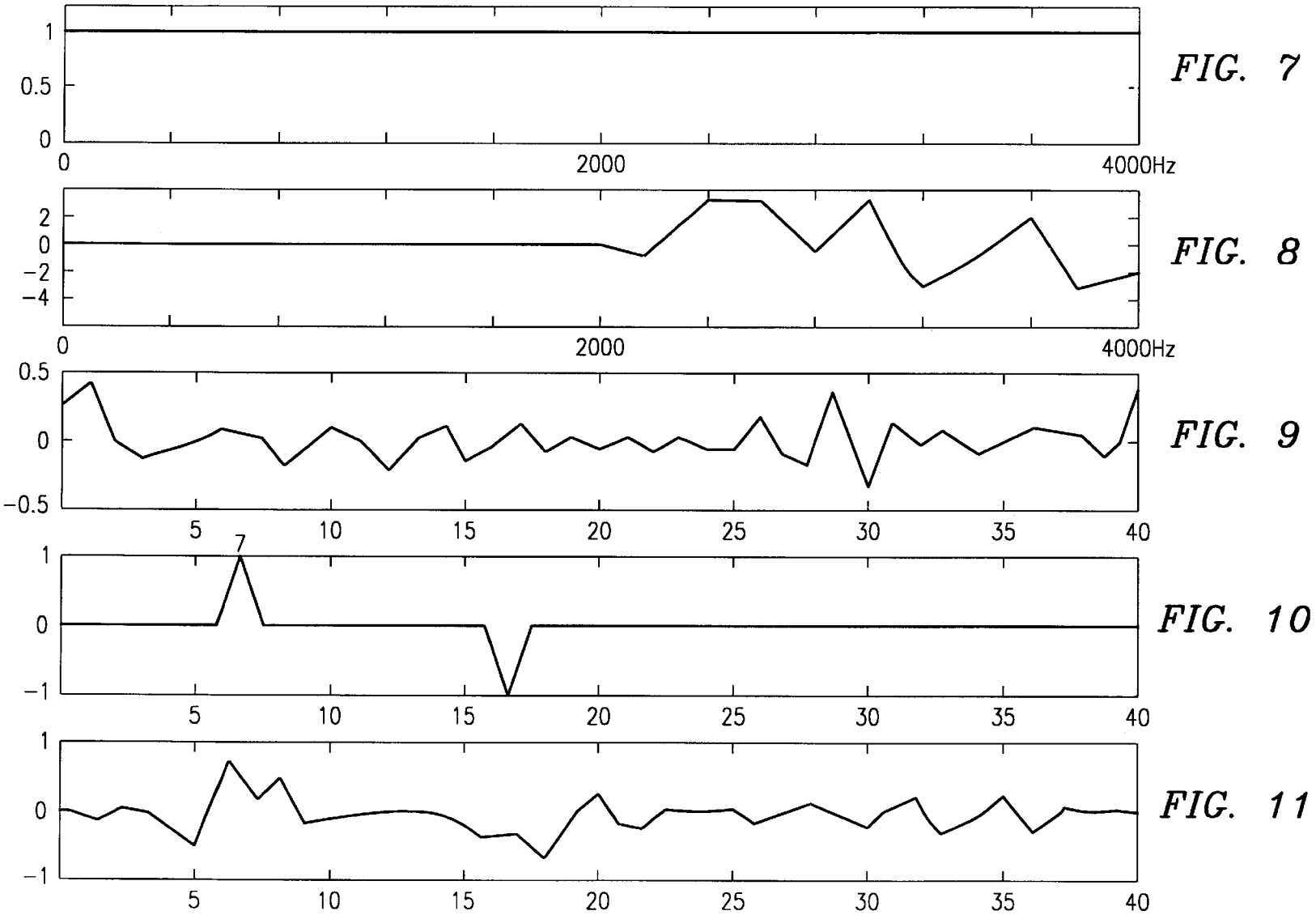
FIGS. 7–11 illustrate graphically the operation of an anti-sparseness filter of the type illustrated in FIG. 6.

FIG. 10 illustrates an example of an entry from the codebook 21 of FIG. 2 having only two non-zero samples out of a total of forty samples. This sparseness characteristic will be reduced if the number (density) of non-zero samples can be increased. One way to increase the number of non-zero samples is to apply the codebook entry of FIG. 10 to a filter having a suitable characteristic to disperse the energy throughout the block of forty samples. FIGS. 7 and 8 respectively illustrate the magnitude and phase (in radians) characteristics of an all-pass filter which is operable to appropriately disperse the energy throughout the forty samples of the FIG. 10 codebook entry. The filter of FIGS. 7 and 8 alters the phase spectrum in the high frequency area between 2 and 4 kHz, while altering the low frequency areas below 2 kHz only very marginally. The magnitude spectrum remains essentially unaltered by the filter of FIGS. 7 and 8.

Example FIG. 9 illustrates graphically the impulse response of the all-pass filter defined by FIGS. 7 and 8. The anti-sparseness filter of FIG. 6 produces a convolution of the FIG. 9 impulse response on the FIG. 10 block of samples. Because the codebook entries are provided from the codebook as blocks of forty samples, the convolution operation is performed in blockwise fashion. Each sample in FIG. 10 will produce 40 intermediate multiplication results in the convolution operation. Taking the sample at position 7 in FIG. 10 as an example, the first 34 multiplication results are assigned to positions 7–40 of the FIG. 11 result block, and the remaining 6 multiplication results are "wrapped around" according to a circular convolution operation such that they are assigned to positions 1–6 of the result block. The 40 intermediate multiplication results produced by each of the remaining FIG. 10 samples are assigned to positions in the FIG. 11 result block in analogous fashion, and sample 1 of course needs no wrap around. For each position in the result block of FIG. 11, the 40 intermediate multiplication results assigned thereto (one multiplication result per sample in FIG. 10) are summed together, and that sum represents the convolution result for that position.

It is clear from inspection of FIGS. 10 and 11 that the circular convolution operation alters the Fourier spectrum of the FIG. 10 block so that the energy is dispersed throughout the block, thereby dramatically increasing the number (or density) of non-zero samples in the block, and correspondingly reducing the amount of sparseness. The effects of performing the circular convolution on a block-by-block basis can be smoothed out by the synthesis filter 211 of FIG. 2.

Figures 12, 13, 14, 15, 16:
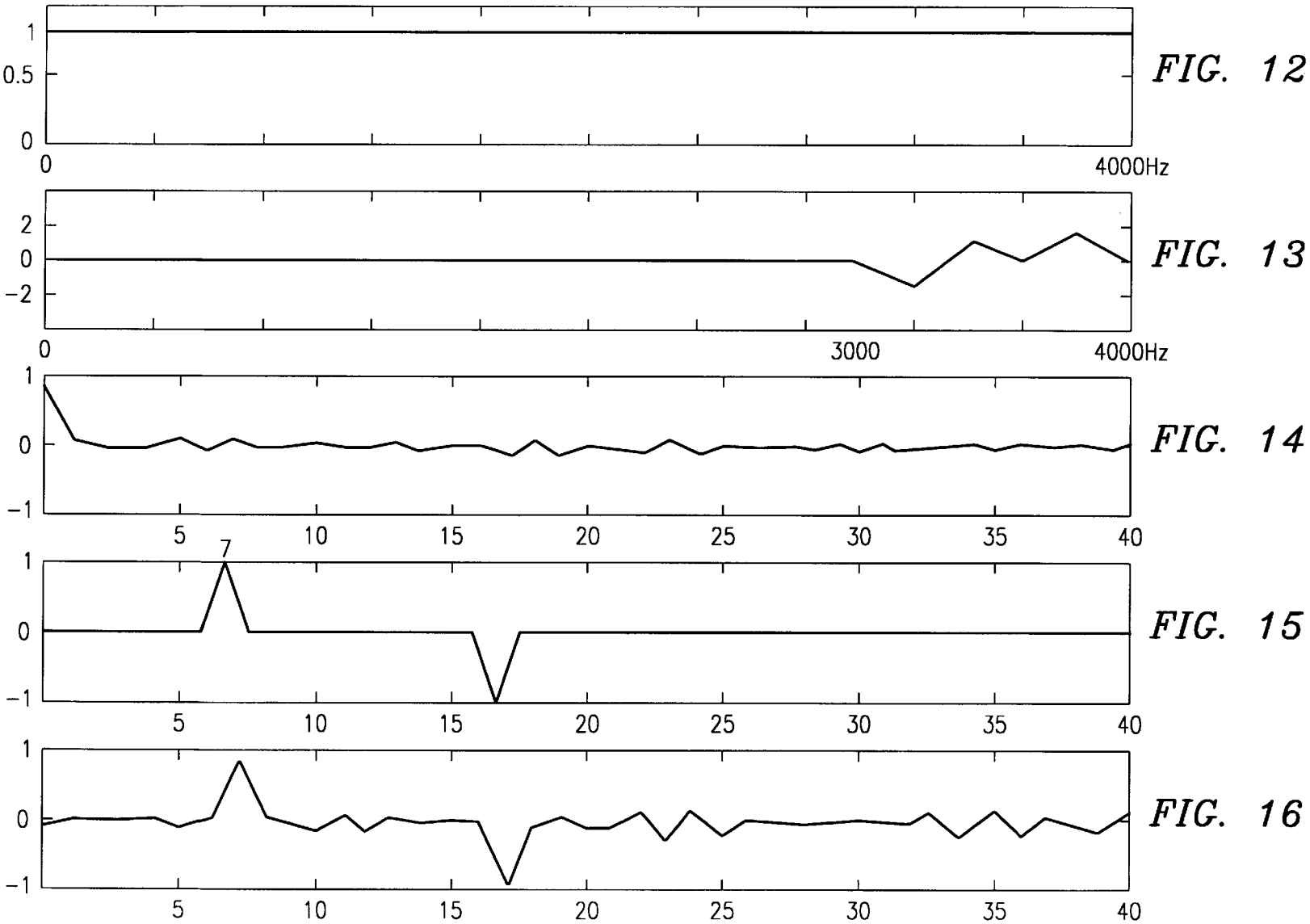
FIGS. 12–16 illustrate graphically the operation of an anti-sparseness filter of the type illustrated in FIG. 6 and at a relatively lower level of anti-sparseness operation than the anti-sparseness filter of FIGS. 7–11.

FIGS. 12–16 illustrate another example of the operation of an anti-sparseness filter of the type shown generally in FIG. 6. The all-pass filter of FIGS. 12 and 13 alters the phase spectrum between 3 and 4 kHz without substantially altering the phase spectrum below 3 kHz. The impulse response of the filter is shown in FIG. 14. Referencing the result block of FIG. 16, and noting that FIG. 15 illustrates the same block of samples as FIG. 10, it is clear that the anti-sparseness operation illustrated in FIGS. 12–16 does not disperse the energy as much as shown in FIG. 11. Thus, FIGS. 12–16 define an anti-sparseness filter which modifies the codebook entry less than the filter defined by FIGS. 7–11. Accordingly, the filters of FIGS. 7–11 and FIGS. 12–16 define respectively different levels of anti-sparseness filtering.

A low adaptive codebook gain value indicates that the adaptive codebook component of the reconstructed excitation signal (output from adder circuit 210) will be relatively small, thus giving rise to the possibility of a relatively large contribution from the fixed (e.g. algebraic) codebook 21. Because of the aforementioned sparseness of the fixed codebook entries, it would be advantageous to select the anti-sparseness filter of FIGS. 7–11 rather than that of FIGS. 12–16 because the filter of FIGS. 7–11 provides a greater modification of the sample block than does the filter of FIGS. 12–16. With larger values of adaptive codebook gain, the fixed codebook contribution is relatively less, so the filter of FIGS. 12–16 which provides less anti-sparseness modification could be used.

The present invention thus provides the capability of using the local characteristics of a given speech segment to determine whether and how much to modify the sparseness characteristic associated with that segment.

The convolution performed in the FIG. 6 anti-sparseness filter can also be linear convolution, which provides smoother operation because blockwise processing effects are avoided. Moreover, although blockwise processing is described in the above examples, such blockwise processing is not required to practice the invention, but rather is merely a characteristic of the conventional CELP speech encoder/decoder structure shown in the examples.

A closed-loop version of the method can be used. In this case, the encoder takes the anti-sparseness modification into account during search of the codebooks. This will give improved performance at the price of increased complexity. The (circular or linear) convolution operation can be implemented by multiplying the filtering matrix constructed from the conventional impulse response of the search filter by a matrix which defines the anti-sparseness filter (using either linear or circular convolution).

Figure 17:
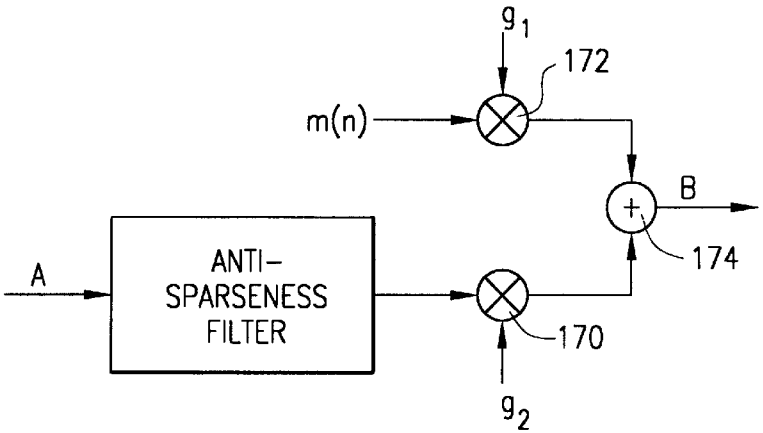
FIG. 17 illustrates another example of the anti-sparseness operator of FIG. 1.

FIG. 17 illustrates another example of the anti-sparseness operator ASO of FIG. 1. In the example of FIG. 17, an anti-sparseness filter of the type illustrated in FIG. 5 receives input signal A, and the output of the anti-sparseness filter is multiplied at 170 by a gain factor $g_2$. The noise-like signal m(n) from FIGS. 3 and 4 is multiplied at 172 by a gain factor $g_1$, and the outputs of the $g_1$ and $g_2$ multipliers 170 and 172 are added together at 174 to produce output signal B. The gain factors $g_1$ and $g_2$ can be determined, for example, as follows. The gain $g_1$ can first be determined in one of the ways described above with respect to the gain of FIG. 3, and then the gain factor $g_2$ can be determined as a function of gain factor $g_1$. For example, gain factor $g_2$ can vary inversely with gain factor $g_1$. Alternatively, the gain factor $g_2$ can be determined in the same manner as the gain of FIG. 3, and then the gain factor $g_1$ can be determined as a function of gain factor $g_2$, for example $g_1$ can vary inversely with $g_2$.

In one example of the FIG. 17 arrangement: the anti-sparseness filter of FIGS. 12–16 is used; gain factor $g_2$=1; m(n) is obtained by normalizing the Gaussian noise distribution N(0,1) of FIG. 4 to have an energy level equal to the fixed codebook entries, and setting the cutoff frequency of the FIG. 4 high pass filter at 200 Hz; and gain factor $g_1$ is 80% of the fixed codebook gain.

Figure 18:
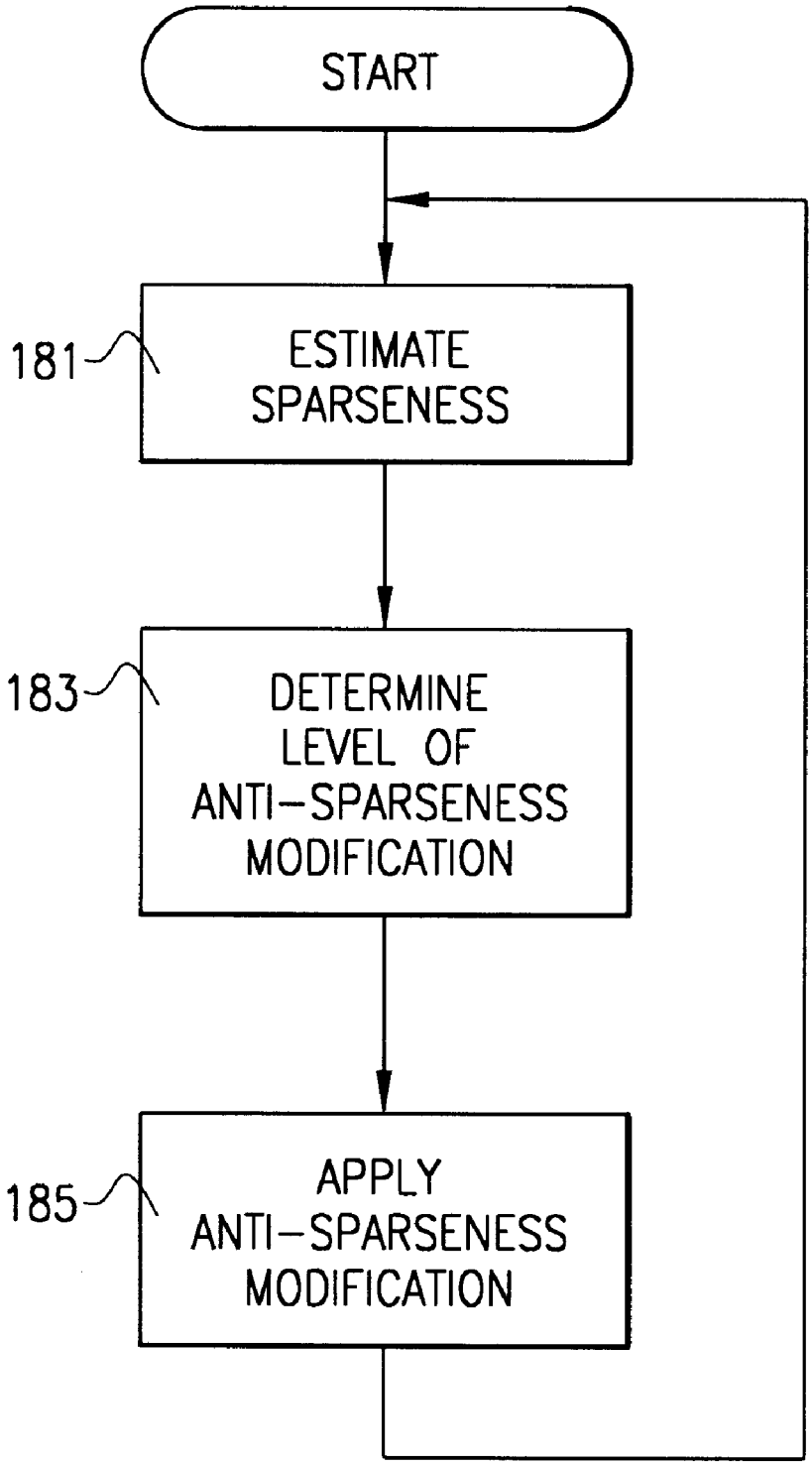
FIG. 18 illustrates an exemplary method of providing anti-sparseness modification according to the invention.

FIG. 18 illustrates an exemplary method of providing anti-sparseness modification according to the invention. At 181, the level of sparseness of the coded speech signal is estimated. This can be done off-line or adaptively during speech processing. For example, in algebraic codebooks and multi-pulse codebooks the samples may be close to each other or far apart, resulting in varying sparseness; whereas in a regular pulse codebook, the distance between samples is fixed, so the sparseness is constant. At 183, a suitable level of anti-sparseness modification is determined. This step can also be performed off-line or adaptively during speech processing as described above. As another example of adaptively determining the anti-sparseness level, the impulse response (see FIGS. 6, 9 and 14) can be changed from block to block. At 185, the selected level of anti-sparseness modification is applied to the signal.

It will be evident to workers in the art that the embodiments described above with respect to FIGS. 1–18 can be readily implemented using, for example, a suitably programmed digital signal processor or other data processor, and can alternatively be implemented using, for example, such suitably programmed digital signal processor or other data processor in combination with additional external circuitry connected thereto.

Although exemplary embodiments of the present invention have been described above in detail, this does not limit the scope of the invention, which can be practiced in a variety of embodiments.

What is claimed is:

1. An apparatus for reducing sparseness in an input digital signal, comprising:

an input to receive the input digital signal, the input digital signal derived from an analog signal and including a first sequence of sample blocks which correspond respectively to timewise successive segments of the analog signal, each sample block including a sequence of sample values;

an anti-sparseness operator coupled to said input and responsive to the input digital signal for producing therefrom an output digital signal which includes a further sequence of sample blocks that respectively timewise correspond to said sample blocks of said first sequence of sample blocks, each sample block of said further sequence of sample blocks including a sequence of sample values, said sequence of sample values in each sample block of said further sequence of sample blocks having a greater density of non-zero sample values than the sequence of sample values in the corresponding sample block of said first sequence of sample blocks; and an output coupled to said anti-sparseness operator to receive therefrom said output digital signal.

2. The apparatus of claim 1, wherein said anti-sparseness operator includes a circuit for adding to the input digital signal a noise-like signal.

3. The apparatus of claim 1, wherein said anti-sparseness operator includes a filter coupled to said input to filter the input digital signal.

4. The apparatus of claim 3, wherein said filter is an all-pass filter.

5. The apparatus of claim 3, wherein said filter uses one of circular convolution and linear convolution to filter sample values in respective sample blocks in said first sequence of sample blocks.

6. The apparatus of claim 3, wherein said filter modifies a phase spectrum of said input digital signal but leaves a magnitude spectrum thereof substantially unaltered.

7. The apparatus of claim 1, wherein said anti-sparseness operator includes a signal path extending from said input to said output, said signal path including a filter, and said anti-sparseness operator also including a circuit for adding a noise-like signal to a signal carried by said signal path.

8. The apparatus of claim 7, wherein said filter is an all-pass filter.

9. The apparatus of claim 7, wherein said filter uses one of circular convolution and linear convolution to filter sample values in respective sample blocks in the first sequence of sample blocks.

10. The apparatus of claim 7, wherein said filter modifies a phase spectrum of the input digital signal but leaves a magnitude spectrum thereof substantially unaltered.

11. An apparatus for processing acoustical signal information, comprising:

an input for receiving the acoustical signal information, said acoustical signal information representing an analog acoustical signal;

a coding apparatus coupled to said input and responsive to said information for providing a digital signal, said digital signal including a first sequence of sample blocks which correspond respectively to timewise successive segments of the analog acoustical signal, each sample block including a sequence of sample values; and an anti-sparseness operator having an input coupled to said coding apparatus and responsive to said digital signal for producing therefrom an output digital signal which includes a second sequence of sample blocks that respectively timewise correspond to said sample blocks of said first sequence of sample blocks, each sample block of said second sequence of sample blocks including a sequence of sample values, said sequence of sample values in each sample block of said second sequence of sample blocks having a greater density of non-zero sample values than the sequence of sample values in the corresponding sample block of said first sequence of sample blocks.

12. The apparatus of claim 11, wherein said coding apparatus includes a plurality of codebooks, a summing circuit and a synthesis filter, said codebooks having respective outputs coupled to respective inputs of said summing circuit, and said summing circuit having an output coupled to an input of said synthesis filter.

13. The apparatus of claim 12, wherein said anti-sparseness operator input is coupled to one of said codebook outputs.

14. The apparatus of claim 12, wherein said anti-sparseness operator input is coupled to said output of said summing circuit.

15. The apparatus of claim 12, wherein said anti-sparseness operator input is coupled to an output of said synthesis filter.

16. The apparatus of claim 12, wherein said coding apparatus is an encoding apparatus and the acoustical signal information is said analog acoustical signal.

17. The apparatus of claim 12, wherein said coding apparatus is a decoding apparatus and the acoustical signal information includes information from which said analog acoustical signal is to be constructed.

18. A method of reducing sparseness in an input digital signal, comprising:

receiving the input digital signal, the input digital signal derived from an analog signal and including a first sequence of sample blocks which correspond respectively to timewise successive segments of the analog signal, each sample block including a sequence of sample values;

producing in response to the input digital signal an output digital signal which includes a second sequence of sample blocks that respectively timewise correspond to said sample blocks of said first sequence of sample blocks, each sample block of said second sequence of sample blocks including a sequence of sample values, said sequence of sample values in each sample block of said second sequence of sample blocks having a greater density of non-zero sample values than the sequence of sample values in the corresponding sample block of said first sequence of sample blocks; and outputting the output digital signal.

19. The method of claim 18, wherein said producing step includes filtering the input digital signal.

20. The method of claim 19, wherein said filtering step includes using an all-pass filter.

21. The method of claim 19, wherein said filtering step includes using one of circular convolution and linear convolution to filter sample values in respective sample blocks of the first sequence of sample blocks.

22. The method of claim 19, wherein said filtering step includes modifying a phase spectrum of the input digital signal but leaving the magnitude spectrum thereof substantially unaltered.

23. The method of claim 18, wherein said producing step includes filtering a first signal to obtain a filtered signal, and adding a noise-like signal to one of said first signal and said filtered signal.

24. The method of claim 23, wherein said filtering step includes using an all-pass filter.

25. The method of claim 23, wherein said filtering step includes using one of circular convolution and linear convolution to filter sample values in respective sample blocks of the first sequence of sample blocks.

26. The method of claim 23, wherein said filtering step includes modifying a phase spectrum of the input digital signal but leaving a magnitude spectrum thereof substantially unaltered.

27. The method of claim 18, wherein said producing step includes adding a noise-like signal to the input digital signal.

28. A method of processing acoustical signal information, comprising:

receiving the acoustical signal information, said acoustical signal information representing an analog acoustical signal;

providing in response to the information a digital signal including a first sequence of sample blocks which correspond respectively to timewise successive segments of the analog acoustical signal, each sample block including a sequence of sample values; and producing in response to the digital signal an output digital signal which includes a further sequence of sample blocks that respectively timewise correspond to said sample blocks of said first sequence of sample blocks, each sample block of said further sequence of sample blocks including a sequence of sample values, the sequence of sample values in each sample block of said further sequence of sample blocks having a greater density of non-zero sample values than the sequence of sample values in the corresponding sample block of said first sequence of sample blocks.

29. An apparatus for reducing sparseness in an input digital signal which includes a first sequence of sample values, comprising:

an input to receive the input digital signal;

an anti-sparseness operator coupled to said input and responsive to the input digital signal for producing an output digital signal which includes a further sequence of sample values, said further sequence of sample values having a greater density of non-zero sample values than the first sequence of sample values, said anti-sparseness operator operable to perform a convolution operation on respective blocks of sample values in said first sequence of sample values; and an output coupled to said anti-sparseness operator to receive therefrom said output digital signal.

30. An apparatus for processing acoustical signal information, comprising:

an input for receiving the acoustical signal information;

a coding apparatus coupled to said input and responsive to said information for providing a digital signal, said digital signal including a first sequence of sample values; and an anti-sparseness operator having an input coupled to said coding apparatus and responsive to said digital signal for producing an output digital signal which includes a second sequence of sample values, said second sequence of sample values having a greater density of non-zero sample values than the first sequence of sample values, said anti-sparseness operator operable to perform a convolution operation on respective blocks of sample values in said first sequence of sample values.

31. A method of reducing sparseness in an input digital signal which includes a first sequence of sample values, comprising:

receiving the input digital signal;

producing in response to the input digital signal an output digital signal which includes a second sequence of sample values, said second sequence of sample values having a greater density of non-zero sample values than the first sequence of sample values, said producing step including performing a convolution operation on respective blocks of sample values in said first sequence of sample values; and outputting the output digital signal.

32. A method of processing acoustical signal information, comprising:

receiving the acoustical signal information;

providing in response to the information a digital signal including a first sequence of sample values; and producing in response to the digital signal an output digital signal which includes a further sequence of sample values, the further sequence of sample values having a greater density of non-zero sample values than the first sequence of sample values, said producing step including performing a convolution operation on respective blocks of sample values in said first sequence of sample values.

* * * * *